US011097545B2

(12) United States Patent
Iimura et al.

(10) Patent No.: US 11,097,545 B2
(45) Date of Patent: Aug. 24, 2021

(54) LIQUID EJECTION DEVICE, CLEANING APPARATUS AND CLEANING METHOD FOR MODULE SUBSTRATE

(71) Applicant: CANON KABUSHIKI KAISHA, Tokyo (JP)

(72) Inventors: Akiko Iimura, Utsunomiya (JP); Hisashi Namba, Utsunomiya (JP); Noriyasu Hasegawa, Utsunomiya (JP); Masahiro Kuri, Utsunomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/524,300

(22) Filed: Jul. 29, 2019

(65) Prior Publication Data

US 2020/0047506 A1 Feb. 13, 2020

(30) Foreign Application Priority Data

| | | |
|---|---|---|
| Aug. 9, 2018 | (JP) | JP2018-150299 |
| Dec. 26, 2018 | (JP) | JP2018-243197 |
| Dec. 27, 2018 | (JP) | JP2018-245000 |
| Jul. 1, 2019 | (JP) | JP2019-122806 |

(51) Int. Cl.
*B41J 2/165* (2006.01)

(52) U.S. Cl.
CPC .. *B41J 2/16517* (2013.01); *B41J 2002/16567* (2013.01)

(58) Field of Classification Search
CPC .. B41J 2/16517; B41J 2/1652; B41J 2/16523; B41J 2/16526; B41J 2002/16567
See application file for complete search history.

(56) References Cited

U.S. PATENT DOCUMENTS

| | | | | |
|---|---|---|---|---|
| 2015/0144709 | A1* | 5/2015 | Ishibashi | B41J 2/16535 239/1 |
| 2016/0318306 | A1* | 11/2016 | Matsuduki | B41J 2/16552 |

FOREIGN PATENT DOCUMENTS

| | | | | |
|---|---|---|---|---|
| JP | 2014094518 A | * | 5/2014 | B41J 2/16526 |
| JP | 2015120332 A | | 7/2015 | |

* cited by examiner

*Primary Examiner* — Jason S Uhlenhake
(74) *Attorney, Agent, or Firm* — Venable LLP

(57) ABSTRACT

A liquid ejection device, a cleaning apparatus and a cleaning method for a module substrate, which can remove foreign matter on an ejection opening face and in a flow path connected with an ejection opening is provided. For that purpose, an ejection opening face is covered with liquid, cleaning is performed by driving a device configured to vibrate liquid, and after that the liquid is collected.

16 Claims, 13 Drawing Sheets

LIQUID EJECTION DEVICE, CLEANING APPARATUS AND CLEANING METHOD FOR MODULE SUBSTRATE

BACKGROUND OF THE INVENTION

Field of the Invention

The present invention relates to a liquid ejection device for ejecting an imprint material, a cleaning apparatus for cleaning a module substrate, and a cleaning method for a module substrate.

Description of the Related Art

In Japanese Patent Laid-Open No. 2015-120332, there is disclosed a method of collecting substances adhering in the vicinity of an ejection using a device configured to move liquid. The device holds liquid between an ejection opening face and one surface of a liquid-holding portion and, moving along the ejection opening face, sucks liquid on the ejection opening face. A device configured to collect liquid collects the liquid.

SUMMARY OF THE INVENTION

The liquid ejection device of the present invention includes a storage container for storing liquid, a device configured to eject liquid, a device configured to hold liquid, a device configured to collect liquid, and a device configured to vibrate liquid. The device configured to eject liquid being for ejecting the liquid stored in the storage container from an ejection opening provided on an ejection opening face. The device configured to hold liquid being capable of holding the liquid between itself and the ejection opening face. The device configured to collect liquid being for collecting the liquid held with the device configured to hold liquid. The device configured to vibrate liquid being for vibrating the liquid held with the device configured to hold liquid.

Further features of the present invention will become apparent from the following description of exemplary embodiments with reference to the attached drawings.

DESCRIPTION OF THE EMBODIMENTS

In the method disclosed in Japanese Patent Laid-Open No. 2015-120332, although foreign matter adhering to the ejection opening face can be collected, foreign matter in a flow path connecting with the ejection opening may not be removed.

Accordingly, the present invention provides a liquid ejection device, a cleaning apparatus, and a cleaning method for a module substrate that can remove foreign matter on an ejection opening face and in a flow path connecting with the ejection opening.

First Embodiment

Figure 1:
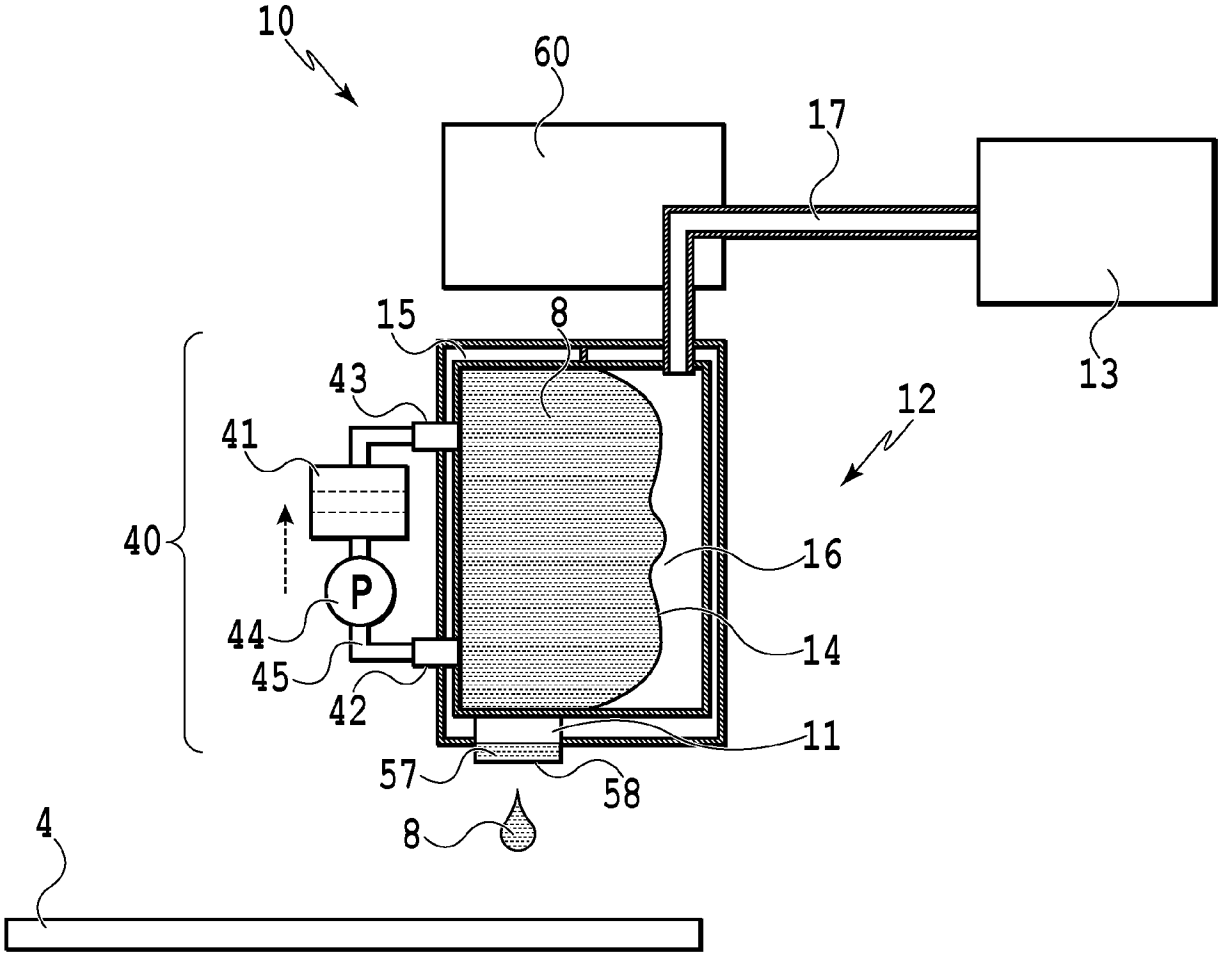
FIG. 1 illustrates a view showing a configuration of a principal part of a liquid ejection device.

Hereinafter, a first embodiment will be explained with reference to drawings. FIG. 1 illustrates a view showing a configuration of a principal part of a liquid ejection device 10. The liquid ejection device 10 mainly includes an ejection portion 11, a storage container 12, a pressure control portion 13, a circulation portion 40 for circulating a substance to be ejected (hereinafter, also referred to as liquid) 8 such as an imprint material in the storage container 12, and a controller 60. The liquid ejection device 10 can eject the liquid 8 in the storage container 12 from an ejection opening provided for a module substrate 57 of the ejection portion 11 to a substrate 4. The ejection opening is provided for an ejection opening face 58 of the module substrate 57. In the inside of the storage container 12 capable of storing fluid, a separation membrane 14 for separating the space in the inside and is formed from a flexible member is provided. The separation membrane 14 preferably has a thickness from not less than 10 μm to not more than 200 μm, and preferably is formed from a material having low permeability for liquid and gas.

The separation membrane 14 can be formed from a film of fluorocarbon resin materials such as PFA, or a composite multilayer film obtained by combining a fluorocarbon resin material and a plastic material. In a first storage portion 15 of the storage container 12 divided with the separation membrane 14, the liquid 8 is stored, and in another second storage portion 16, filling liquid is stored. The first storage portion 15 is separated from the second storage portion 16 with the separation membrane 14. The second storage portion 16 is connected with the pressure control portion 13 with a connecting pipe 17, and the first storage portion 15 is connected with the ejection portion 11.

The pressure control portion 13 includes a filling liquid tank, a pipe arrangement, a pressure sensor, a pump, a valve etc., and is configured to be capable of controlling the pressure inside the second storage portion 16. By controlling the pressure of the filling liquid in the second storage portion 16 with the pressure control portion 13, the pressure of the liquid 8 in the first storage portion 15 can be controlled via the separation membrane 14. Consequently, it is possible to stabilize the shape of gas-liquid interface in the ejection portion 11, and to eject the liquid 8 with sufficient reproducibility.

The circulation portion 40 has a configuration such that, on the outer side of the storage container 12, a pathway 45 connected with the storage container 12 at both ends is provided and a filter 41 and a pump 44 are arranged to the pathway 45. The circulation portion 40 is in connection with the first storage portion 15 of the storage container 12, and the pathway 45 is communicated with the first storage portion 15 through a first opening 43 and a second opening 42 opened in the first storage portion 15. The first opening 43 is an opening for supplying the liquid 8 in the first storage portion 15 to the inside of the pathway 45, and the second opening 42 is an opening for supplying again the liquid 8 to the first storage portion 15, the liquid 8 having been supplied to the pathway 45 from the first opening 43. To the pathway 45 that connects the first opening 43 with the second opening 42, the pump 44 and the filter 41 for filtrating the liquid 8 are arranged. In consideration of a case where possibility of appearance of foreign matter for the liquid 8 due to dust emission from the pump 44, the filter 41 is preferably arranged in a position lying on the downstream side relative to the pump 44 when the liquid 8 is made to flow from the first opening 43 to the second opening 42.

The pump 44 is preferably provided in a pathway of the pathway 45, but may be provided in the outside of the pathway 45. When the pump 44 is driven, the liquid 8 stored inside the first storage portion 15 is supplied to the pathway 45 from the first opening 43. The liquid 8 supplied from the first opening 43 passes through the filter 41 inside the pathway and filtrated, and after that returns to the inside of the first storage portion 15 through the second opening 42. Then, it is supplied again from the first opening 43. In other words, the liquid 8 inside the first storage portion 15 is filtrated by the filter 41 with circulation.

Figure 2A:
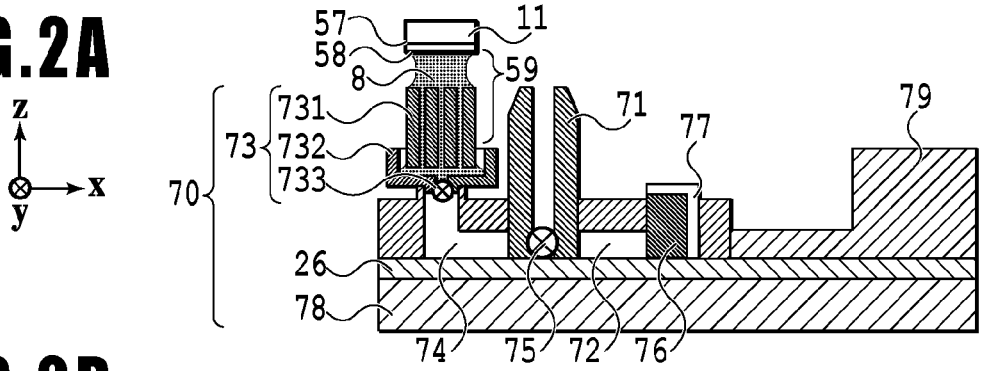
FIG. 2A illustrates a schematic view showing a collecting unit for collecting a substance to be ejected left in an ejection portion.

FIG. 2A to FIG. 2E illustrate schematic views showing a collecting unit 70 for collecting the liquid 8, which is provided for the liquid ejection device 10. FIG. 2A illustrates a view showing a state where the liquid 8 is held by a liquid-holding portion 59 in a state where the ejection portion 11 faces a collecting portion 73 of the collecting unit 70. The liquid-holding portion 59 is a portion where the ejection opening face 58 of the ejection portion 11 faces the collecting portion 73 or alternatively a sucking portion 71, in which the liquid 8 is held in a manner of forming a liquid column. The liquid column is formed on the entire surface of the ejection opening face 58. The collecting unit 70 can hold liquid, and includes the collecting portion 73 capable of performing collection, a collection flow path 74 communicated with the collecting portion 73, the sucking portion 71 capable of sucking liquid, and a sucking flow path 72 communicated with the sucking portion 71.

Furthermore, the collecting unit 70 includes a three-way valve 75 for switching between a flow path communicating with the collecting portion 73 and a flow path communicating with the sucking portion 71, a negative pressure-generating mechanism 76 for generating negative pressure for the collecting portion 73 and the sucking portion 71, and a controller 77 for controlling the negative pressure-generating mechanism 76. Additionally, the collecting unit 70 includes a lifting portion 26 for raising and lowering, as necessary, the collecting portion 73 and the sucking portion 71, a moving portion 78 for moving the collecting portion 73 and the sucking portion 71, and a storage container 79 for storing the liquid 8 collected from the collecting portion 73 and the sucking portion 71.

The ejection opening face 58 of the ejection portion 11 is not in contact with the collecting portion 73 nor with the sucking portion 71. The collecting unit 70 can reciprocate in an X direction by the moving portion 78, and can move to a position facing the ejection opening face 58 of the ejection portion 11 to hold, collect and suck the liquid 8. Moreover, as necessary, by moving the collecting portion 73 or the sucking portion 71 in a Z direction using the lifting portion 26, positioning can be performed relative to the ejection portion 11.

In the liquid ejection device 10 of this embodiment, the collecting portion 73 of the collecting unit 70 is equipped with plural comb tooth-like collecting portions 731, and the plural comb tooth-like collecting portions 731 are disposed in a bucket 732 at a predetermined space. The bucket 732 is equipped with a valve 733 capable of communicating/shutting off the inside of the bucket 732 with/from the collection flow path 74.

Figure 2B:
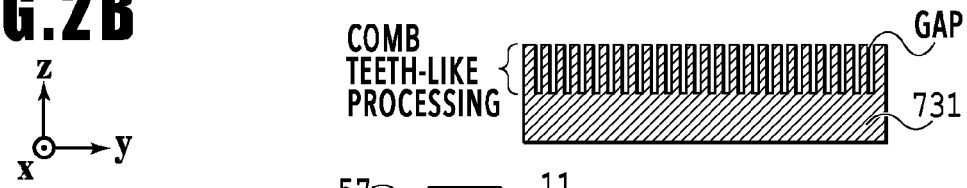
FIG. 2B illustrates a schematic view showing a collecting unit collecting a substance to be ejected left in an ejection portion.

FIG. 2B illustrates a view showing an arbitrary comb tooth-like collecting portion 731 among the plural comb tooth-like collecting portions 731. The comb tooth-like collecting portion 731 has been subjected to comb tooth-like processing, and the comb tooth-like collecting portion 731 is equipped with plural comb teeth provided at a predetermined space. The space between comb teeth is preferably set in accordance with the viscosity of liquid to be used. The collecting portion 73 of the collecting unit 70 forms the liquid-holding portion 59 as a consequence of facing the ejection opening face 58. In the liquid-holding portion 59, the liquid 8 is held between comb tooth-like collecting portions 731 and between comb teeth by a capillary action. Liquid has viscosity, and in the liquid-holding portion 59, the liquid 8 can be held as a liquid column between the collecting portion 73 and the ejection portion 11.

When the liquid 8 is held, the valve 733 is closed and the collecting portion 73 is arranged facing the ejection opening face 58, the pressure of filling liquid in the second storage portion 16 is controlled with the pressure control portion 13, the liquid 8 in the first storage portion 15 is pushed out from the ejection portion 11 via the separation membrane 14, and the liquid 8 is held with the liquid-holding portion 59. Meanwhile, it is also possible to eject the liquid 8 from the ejection portion 11 with an energy-generating element described later, to fill the liquid-holding portion 59 with the liquid 8 and hold the same.

Figure 2C:
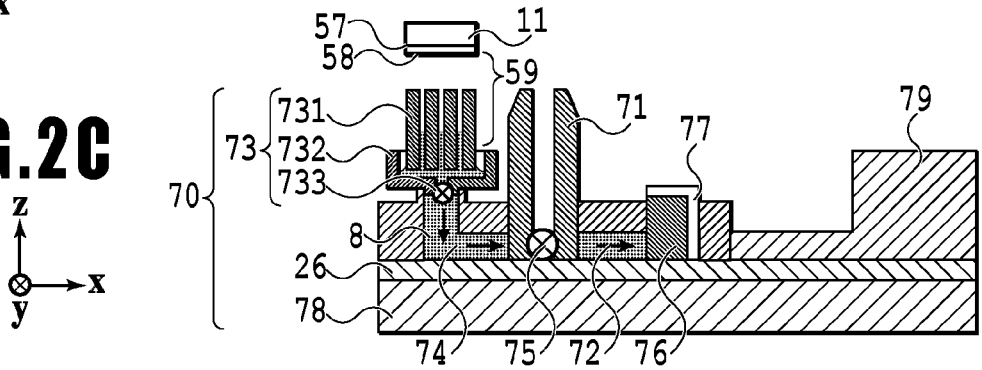
FIG. 2C illustrates a schematic view showing a collecting unit collecting a substance to be ejected left in an ejection portion.

FIG. 2C illustrates a view showing a situation where the liquid held with the liquid-holding portion 59 is collected. In the liquid ejection device 10, cleaning for removing foreign matter in the flow path in the module substrate 57 is performed, in a state where the liquid is held with the liquid-holding portion 59. This cleaning for the module substrate 57 will be described later. After the cleaning for the module substrate 57, the liquid 8 held with the liquid-holding portion 59 is collected via the collection flow path 74 communicated with the collecting portion 73 by the action of the negative pressure-generating mechanism 76, and is stored in the storage container 79. To collect the liquid 8 held with the liquid-holding portion 59, first, the valve 733 provided for the bucket 732 is opened, and the three-way valve 75 is switched so that the negative pressure due to the negative pressure-generating mechanism 76 acts on the collecting portion 73. After that, by driving the negative pressure-generating mechanism 76, the negative pressure is applied to the collecting portion 73 to make it possible to collect the liquid 8 held with the liquid-holding portion 59 and to store the same in the storage container 79.

In this embodiment, by employing plural comb tooth-like collecting portions 731 as the liquid-holding portion 59, it is possible to apply the negative pressure to a large amount of held liquid 8 approximately at the same time and to collect the liquid 8 in a short period of time, when liquid column-like liquid 8 and liquid 8 between plural comb tooth-like collecting portions 731 are collected.

Figure 2D:
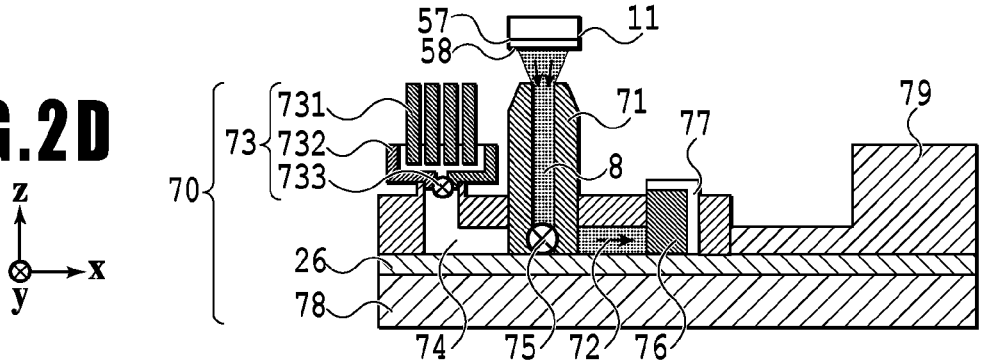
FIG. 2D illustrates a schematic view showing a collecting unit collecting a substance to be ejected left in an ejection portion.

FIG. 2D illustrates a view showing a situation of sucking the liquid 8 left on the ejection opening face 58 with the sucking portion 71. Of the sucking portion 71 and the collecting portion 73, the sucking portion 71 is equipped with an opening diameter, and the sucking portion 71 can suck the liquid 8 from the ejection opening face 58 more effectively than the collecting portion 73. After collecting the liquid 8 held with the liquid-holding portion 59, with the collecting portion 73, the liquid 8, which has not been completely collected with the collecting portion 73, may be left on the ejection opening face 58 in an adhering state. In the case where the liquid 8 is left on the ejection opening face 58 in this way, the sucking portion 71 is moved to a position facing the ejection portion 11, as in FIG. 2D, and the three-way valve 75 is switched so that the negative pressure due to the negative pressure-generating mechanism 76 acts on the sucking portion 71. After that, by driving the negative pressure-generating mechanism 76, it is possible to apply the negative pressure to the sucking portion 71, to suck the liquid 8 left on the ejection opening face 58, and to store the same in the storage container 79. Consequently, the liquid 8 on the ejection opening face 58 can be collected.

Figure 2E:
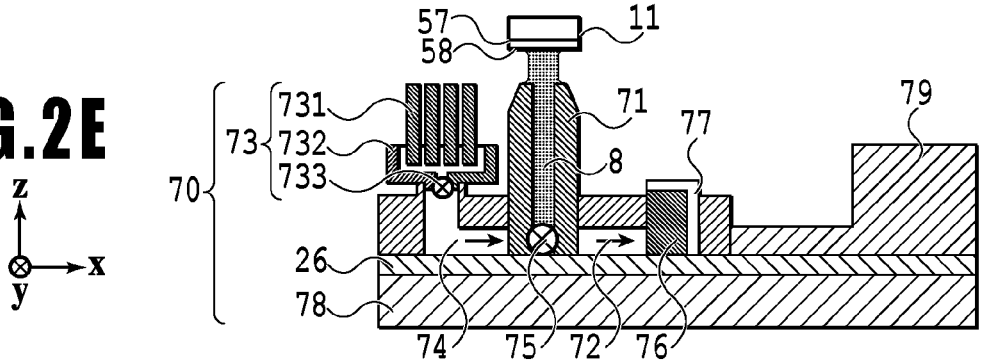
FIG. 2E illustrates a schematic view showing a collecting unit collecting a substance to be ejected left in an ejection portion.

Meanwhile, it is also possible to form a liquid column between the ejection opening face 58 and the sucking portion 71 and to hold the liquid 8 as shown in FIG. 2E by moving the sucking portion 71 in the Z direction using the lifting portion 26 and setting the distance from the ejection opening face 58 to a predetermined distance. The surface of the sucking portion 71 facing the ejection opening face 58 is set to be smaller than the surface of the collecting portion 73 facing the ejection opening face 58, and therefore the sucking portion 71 can form a narrower liquid column as compared with the collecting portion 73, and can form partially (in a part) a liquid column for the ejection opening face 58. Accordingly, in a case where the module substrate 57 is cleaned partially, formation of a liquid column with the sucking portion 71 can perform more effective cleaning.

Figure 3:
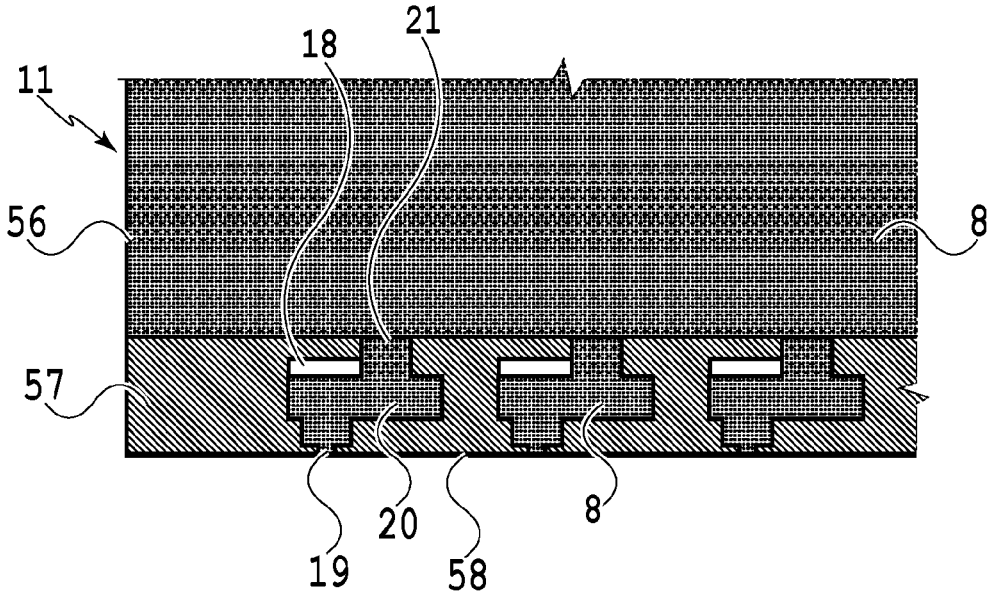
FIG. 3 illustrates a cross-sectional view showing a part of an ejection portion, enlarging the same.

FIG. 3 illustrates a cross-sectional view showing a part of an ejection portion 11, enlarging the same. The ejection portion 11 includes a common liquid chamber 56 and the module substrate 57, and can eject the liquid 8 in the common liquid chamber 56 from an ejection opening 19 of the module substrate 57. The module substrate 57 includes a supply opening 21 for supplying the liquid 8 to the module substrate 57, an energy-generating element 18 for generating ejection energy for ejecting the liquid 8, a pressure chamber 20, and the ejection opening 19 capable of ejecting the liquid 8. The opening area of the ejection opening 19 is smaller than the opening area of the supply opening 21, and has the smallest cross-section in the flow path from the supply opening 21 to the ejection opening 19.

When the liquid 8 is ejected, by driving the energy-generating element 18 with a driving source (not illustrated), the liquid 8 in the pressure chamber 20 is ejected from the ejection opening 19. Elements used as the energy-generating element 18 include piezoelectric elements and heating resistors. Note that a piezoelectric element is preferably used for the energy-generating element 18 because those containing resin are frequently used for the liquid 8. Moreover, the ejection portion 11 is preferably such an ejection head that is used for an ink jet head etc. Meanwhile, supply and suspension of the liquid 8 may also be controlled using a control valve or the like.

In the liquid ejection device 10 of this embodiment, when the module substrate 57 is cleaned, the liquid 8 is held by filling the liquid-holding portion 59 with the liquid 8 to form a liquid column, as in FIG. 2A. When the liquid column is formed, the liquid column may be formed by the control with the pressure control portion 13 or the liquid column may be formed by the driving of the energy-generating element 18, as described above. In this embodiment, the energy-generating element 18 is driven while holding the liquid 8 by forming the liquid column in this way. By driving the energy-generating element 18 in a state where the ejection opening face 58 contacts the liquid by the liquid column upon cleaning as described above, the liquid 8 with increased viscosity in the flow path located near the ejection opening 19 and foreign matter adhering to the ejection opening face 58 can be removed and collected. The principle will be explained below.

With the liquid with increased viscosity in the flow path near the ejection opening 19, the ejection opening face 58 contacts as a consequence of the formation of a liquid column. When the contact is performed, liquid whose viscosity has not been increased is supplied to the liquid with increased viscosity in the flow path from the liquid in the liquid column to decrease the viscosity of the liquid in the flow path. Consequently, the state of increased viscosity of the liquid in the flow path is relaxed. Causes of the increase in viscosity of liquid may include change in a composition of the liquid due to evaporation of the liquid and gelation due to polymerization of the liquid. Therefore, relaxation of the state with increased viscosity of liquid in the flow path may be promoted by using, as cleaning liquid, liquid that contains a volatile component in a large volume and is unlikely to give the increase in viscosity due to change in the composition of the liquid, or liquid from which components that cause the increase in viscosity have been eliminated.

For example, there is an instance where even when viscosity of liquid in a part of the flow path has increased, viscosity of liquid in another flow path is not increased. Therefore, the liquid column to be formed contains liquid whose viscosity is not increased. As a consequence of the contact of the liquid column containing liquid whose viscosity is not increased with liquid whose viscosity has been increased in the flow path in this way, the state of increased viscosity is relaxed. When vibration is applied to the liquid forming the liquid column with the energy-generating element 18 in a state where the state of increased viscosity has been relaxed in this way, liquid that is in the state where increased viscosity has been relaxed and becomes to be removed easily is separated from the flow path and moves from the ejection opening 19 into the liquid column.

Moreover, foreign matter in the flow path including the pressure chamber 20 are also separated from the flow path and move from the ejection opening 19 into the liquid column. In addition, foreign matter adhering to the ejection opening face 58 are also separated from the ejection opening face 58 by the viscosity of the liquid and move into the liquid column, as a consequence of the contact of the ejection opening face 58 with the liquid due to the liquid column. After that, as described above, by collecting the liquid held as the liquid column from the collecting portion 73 by the action of the negative pressure-generating mechanism 76, foreign matter adhering to the ejection opening face 58 and liquid whose viscosity has increased in the flow path can be removed along with the liquid.

As described above, in this embodiment, the cleaning of the module substrate 57 is performed while driving the energy-generating element 18 in a state where a liquid column has been formed between the collecting portion 73 and the ejection opening face 58, and after that the liquid 8 held as the liquid column is collected from the collecting portion 73.

Figure 4:
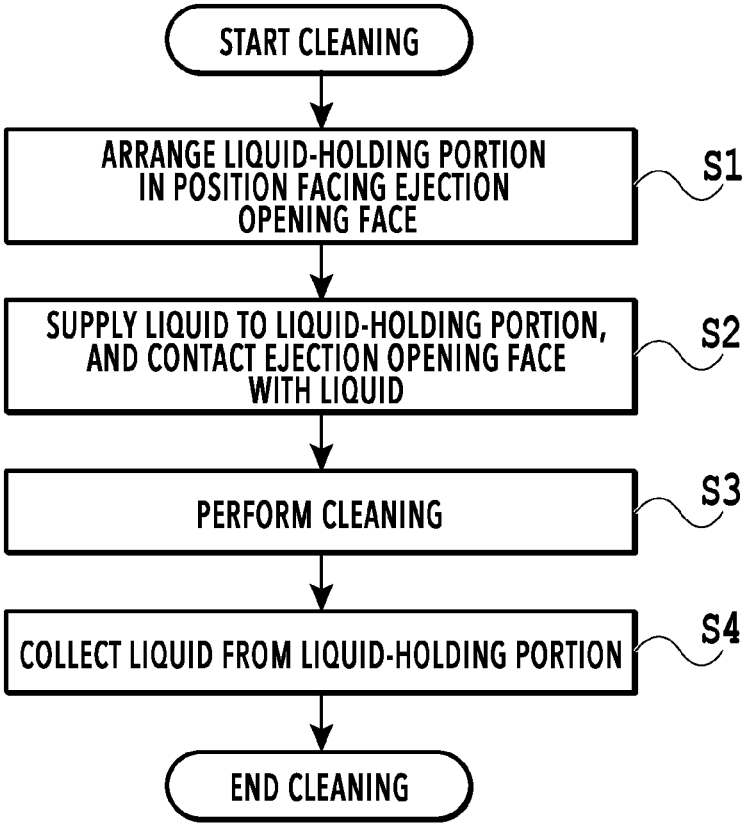
FIG. 4 illustrates a flow chart of a cleaning process for a module substrate.

FIG. 4 illustrates a flow chart of a cleaning process for the module substrate 57 in the liquid ejection device 10 of this embodiment. Hereinafter, with this flow chart, the cleaning process for the module substrate 57 in the liquid ejection device 10 will be explained. Meanwhile, control of respective sequences in the cleaning process is performed with a CPU built in a liquid ejection device, but a computer connected to the liquid ejection device may perform the control.

When the cleaning process for the module substrate 57 is started, the controller 60 moves the collecting unit 70 in S1, and arranges the collecting portion 73 in a position facing the ejection opening face 58. After that, in S2, the controller 60 causes the liquid 8 to be ejected from the ejection opening 19 of the ejection portion 11. Here, the pressure control portion 13 controls the pressure of the filling liquid in the second storage portion 16 to push out the liquid 8 from the ejection portion 11. By pushing out the liquid 8, the liquid-holding portion 59 is filled with the liquid 8, and a liquid column is formed in the liquid-holding portion 59. In this state, a state is given, in which the liquid column formed in the liquid-holding portion 59, and the inside of the module substrate 57 from the ejection opening 19 to the ejection opening 19 and the inside of the flow path to the supply opening 21 including the pressure chamber 20 are filled with the liquid 8. Moreover, as a consequence of the contact of the ejection opening face 58 with the liquid column, foreign matter adhering to the ejection opening face 58 move into the liquid column due to the viscosity of the liquid 8.

Next, in S3, the controller 60 drives the energy-generating element 18 for a predetermined time period to clean the ejection opening 19 and the inside of the flow path. This cleaning moves foreign matter in the flow path to the inside of the liquid column via the ejection opening 19. After that, in S4, the controller 60 causes the liquid 8 forming the liquid column to be collected from the liquid-holding portion 59 via the bucket 732 and the collection flow path 74 due to the action of the negative pressure-generating mechanism 76, and the cleaning process for the module substrate 57 is ended.

Note that, in a case where the liquid 8 is left on the ejection opening face 58 after collecting the liquid 8 in S4, after S4, the collecting unit 70 is moved to a position where the sucking portion 71 faces the ejection opening face 58, and the sucking portion 71 sucks the liquid 8 left on the ejection opening face 58.

As in this embodiment, by driving the energy-generating element 18 and performing the cleaning while holding the liquid 8 by forming the liquid column in the liquid-holding portion 59, foreign matter on the ejection opening face 58, and in the ejection opening 19 and in the flow path including the pressure chamber 20 can be removed.

Meanwhile, in this embodiment, although the cleaning is performed by vibrating the liquid 8 in the ejection opening 19 and in the flow path by driving the energy-generating element 18 in the cleaning, this is not limitative. That is, cleaning may be performed while giving vibration to the liquid 8 with the device configured to vibrate liquid, the device applying directly or indirectly vibration to liquid in the flow path. Here, a "device configured to vibrate liquid, the device applying indirectly vibration" includes one that applies vibration from the outside via the liquid column. Moreover, the ejection portion 11 may be equipped with a device configured to vibrate liquid other than the energy-generating element 18. For example, an ultrasonic generator etc. may be used as a device configured to vibrate liquid.

Moreover, in this embodiment, although an example, in which the same device works as the device configured to hold the liquid 8 and the device configured to collect the liquid 8, has been explained, this is not limitative. A device configured to hold the liquid 8 and a device configured to collect the liquid 8 may be provided separately.

Moreover, in this embodiment, the liquid ejection device 10 is exemplified in the explanation, but the embodiment may be applied to a cleaning apparatus for cleaning the module substrate 57.

Moreover, cleaning may be performed by driving a device configured to vibrate liquid in a state where a liquid column is partially formed relative to the ejection opening face 58 shown in FIG. 2E.

As described above, cleaning is performed by forming a liquid column so as to cover the ejection opening face 58 with the liquid 8 and driving a device configured to vibrate liquid, and after that the liquid 8 forming the liquid column is collected. Consequently, a cleaning method, a cleaning apparatus and a liquid ejection device for the module substrate 57 capable of removing foreign matter in the ejection opening 19 and a flow path connected with the ejection opening 19, can be actualized.

Second Embodiment

Hereinafter, a second embodiment will be explained with reference to the drawings. Meanwhile, the basic configuration of this embodiment is the same as that of the first embodiment, and therefore only characteristic configurations will be explained in what follows.

Figure 5:
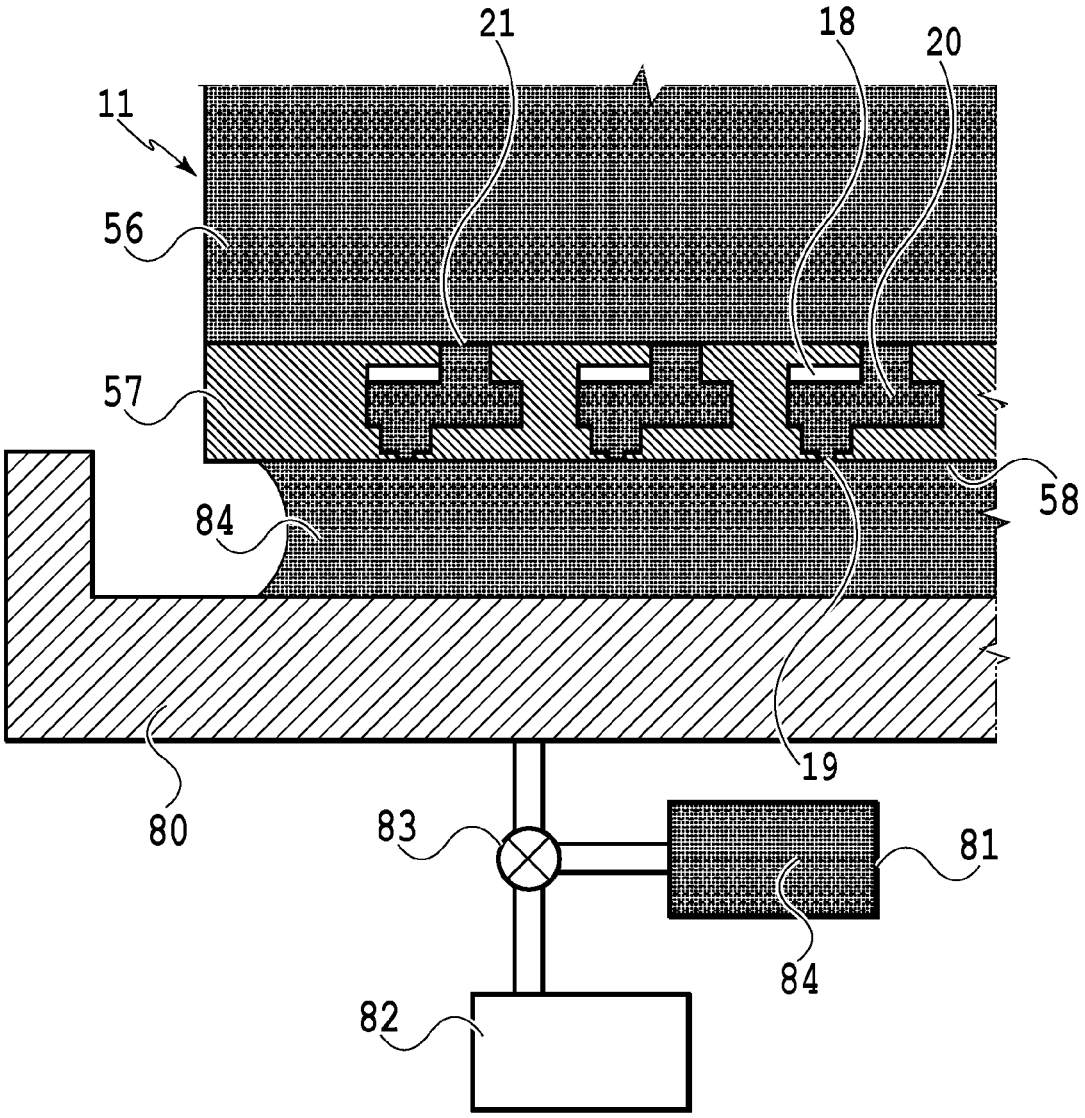
FIG. 5 illustrates a cross-sectional view showing an ejection portion and a holding member of the liquid ejection device.

FIG. 5 illustrates a cross-sectional view showing the ejection portion 11 and a holding member 80 of the liquid ejection device 10 in this embodiment. In the first embodiment, a liquid column is formed in the liquid-holding portion 59 by arranging the collecting portion 73 in a position facing the ejection opening face 58 of the ejection portion 11 and pushing out the liquid 8 from the ejection portion 11. In this embodiment, the holding member 80 in a bucket-like shape is arranged in a position facing the ejection opening face 58 of the ejection portion 11, and a liquid column is formed between the ejection opening face 58 and the holding member 80.

The holding member 80 is configured movably, and in cleaning, moves to a position facing the ejection opening face 58 of the ejection portion 11. The holding member 80 is in connection with a liquid-supplying vessel 81 and a liquid collection opening vessel 82 via a three-way valve 83. A control mechanism (not illustrated) causes the holding member 80 to be communicated with the liquid-supplying vessel 81 through the three-way valve 83, to supply liquid 84 in the liquid-supplying vessel 81 to the holding member 80. Here, the liquid 84 is cleaning liquid, and the use of liquid obtained by removing a component that increases the viscosity from the liquid 8, which can relax the state with increased viscosity of the liquid 8 in a flow path near the ejection opening 19, or the same kind of cleaning liquid as the liquid 8, is preferable. Causes of the increase in viscosity of liquid may include, for example, change in a composition of the liquid due to evaporation of the liquid and gelation due to polymerization of the liquid. Therefore, relaxation of the state with increased viscosity of liquid in the flow path may be promoted by using, as cleaning liquid, liquid that contains a volatile component in a large volume and is unlikely to give the increase in viscosity due to change in the composition of the liquid, or liquid from which components that cause the increase in viscosity have been eliminated. In a case where cleaning liquid different from the liquid 8 is used, a process of removing the cleaning liquid left after the cleaning is necessary. In contrast, the use of the same kind liquid can omit the process of removing the cleaning liquid to shorten a time period necessary for the cleaning.

In a state where a liquid column has been formed between the ejection opening face 58 and the holding member 80, the control mechanism (not illustrated) causes the holding member 80 to be communicated with the liquid collection opening vessel 82 through the three-way valve 83. By driving the energy-generating element 18 in this state, the liquid 84 in the ejection opening 19 and in flow path is vibrated via the holding member 80 to move foreign matter in the ejection opening 19 and in flow path into the liquid column via the ejection opening 19. After that, the liquid 84 held as the liquid column is collected in the liquid collection opening vessel 82. Consequently, along with the liquid 84, foreign matter adhering to the ejection opening face 58 and foreign matter in the flow path can be removed and collected.

Meanwhile, a configuration, which is equipped with a device configured to generate negative pressure such as a pump between the three-way valve 83 and the liquid collection opening vessel 82, is also acceptable.

Third Embodiment

Hereinafter, a third embodiment will be explained with reference to the drawings. Meanwhile, the basic configuration of this embodiment is the same as that of the first embodiment, and therefore only characteristic configurations will be explained below.

Figure 6:
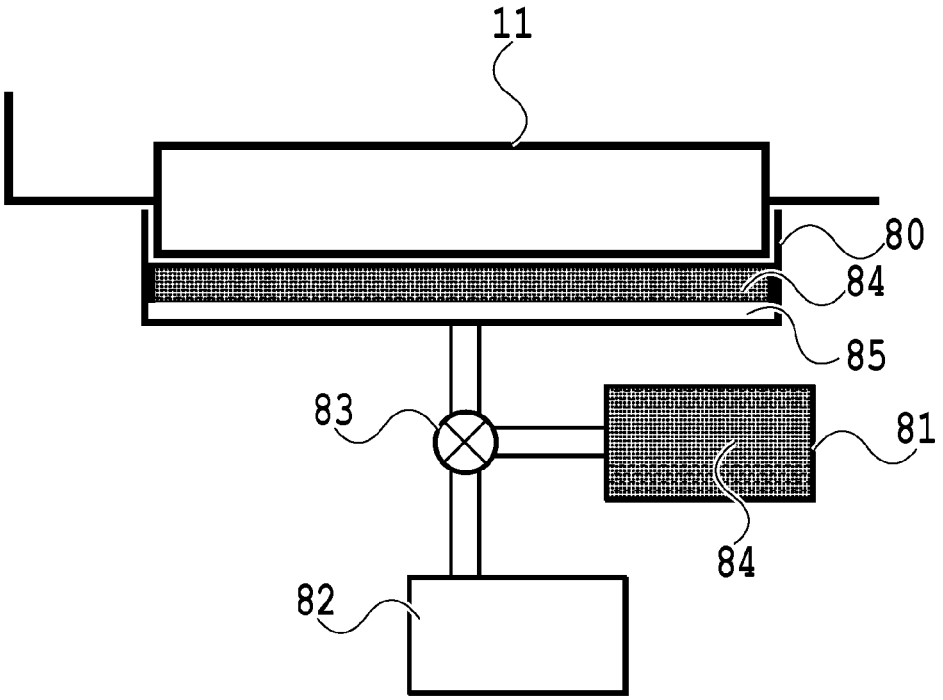
FIG. 6 illustrates a cross-sectional view showing an ejection portion and a holding member of a liquid ejection device in another embodiment.

FIG. 6 illustrates a view showing the third embodiment, and illustrates a cross-sectional view showing the ejection portion 11 and the holding member 80 of a liquid ejection device. The holding member 80 includes a device configured to generate energy 85. In the cleaning, a liquid column is formed between the ejection opening face 58 and the holding member 80, and the device configured to generate energy 85 equipped for the holding member 80 vibrates the liquid 84 held with the holding member 80 to move foreign matter in the ejection opening 19 and in the flow path into the liquid column via the ejection opening 19. The situation that the device configured to generate energy 85 equipped for the holding member 80 vibrates the liquid 84 in this way can also give a similar effect to those given by above-described embodiments. Examples of the device configured to generate energy 85 include a device configured to generate ultrasonic waves, etc.

Fourth Embodiment

Hereinafter, a fourth embodiment will be explained with reference to the drawings. Meanwhile, the basic configuration of this embodiment is the same as that of the first embodiment, and therefore only characteristic configurations will be explained in what follows.

Figure 7:
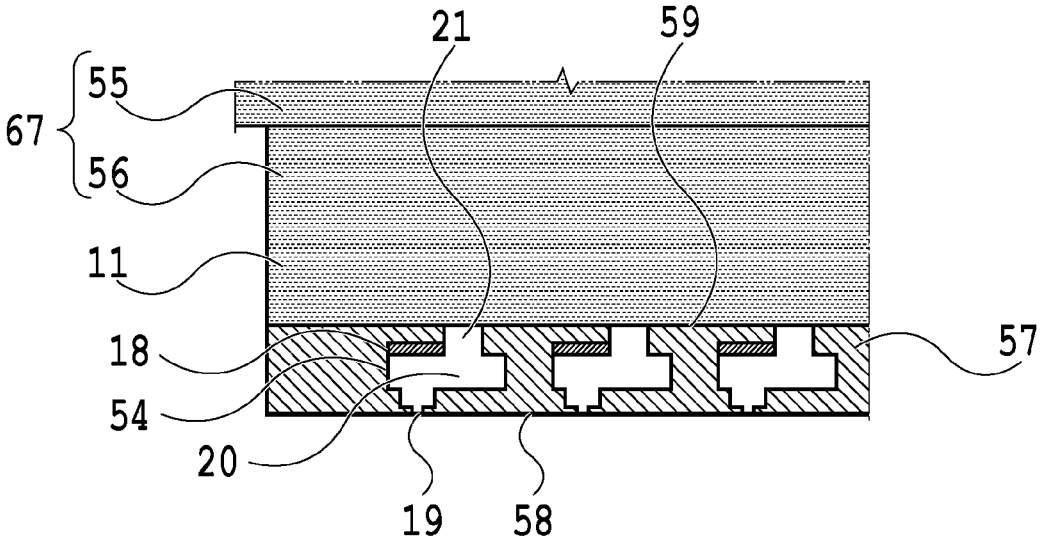
FIG. 7 illustrates a cross-sectional view showing the ejection portion.

FIG. 7 illustrates a cross-sectional view showing the ejection portion 11, enlarging the same. For the module substrate 57, there are provided plural nozzles 54 equipped with the supply opening 21 for supplying liquid (hereinafter, referred to as a substance to be ejected) to the module substrate 57 and the ejection opening 19 capable of ejecting a substance to be ejected. In the inside of the nozzle 54, the energy-generating element 18 for generating energy for ejecting a substance to be ejected is provided. Here, the surface of the module substrate 57 provided with the supply opening 21 is denoted by a supply opening-side surface 59, and the surface provided with the ejection opening 19 is denoted by an ejection opening-side surface 58.

Figure 8:
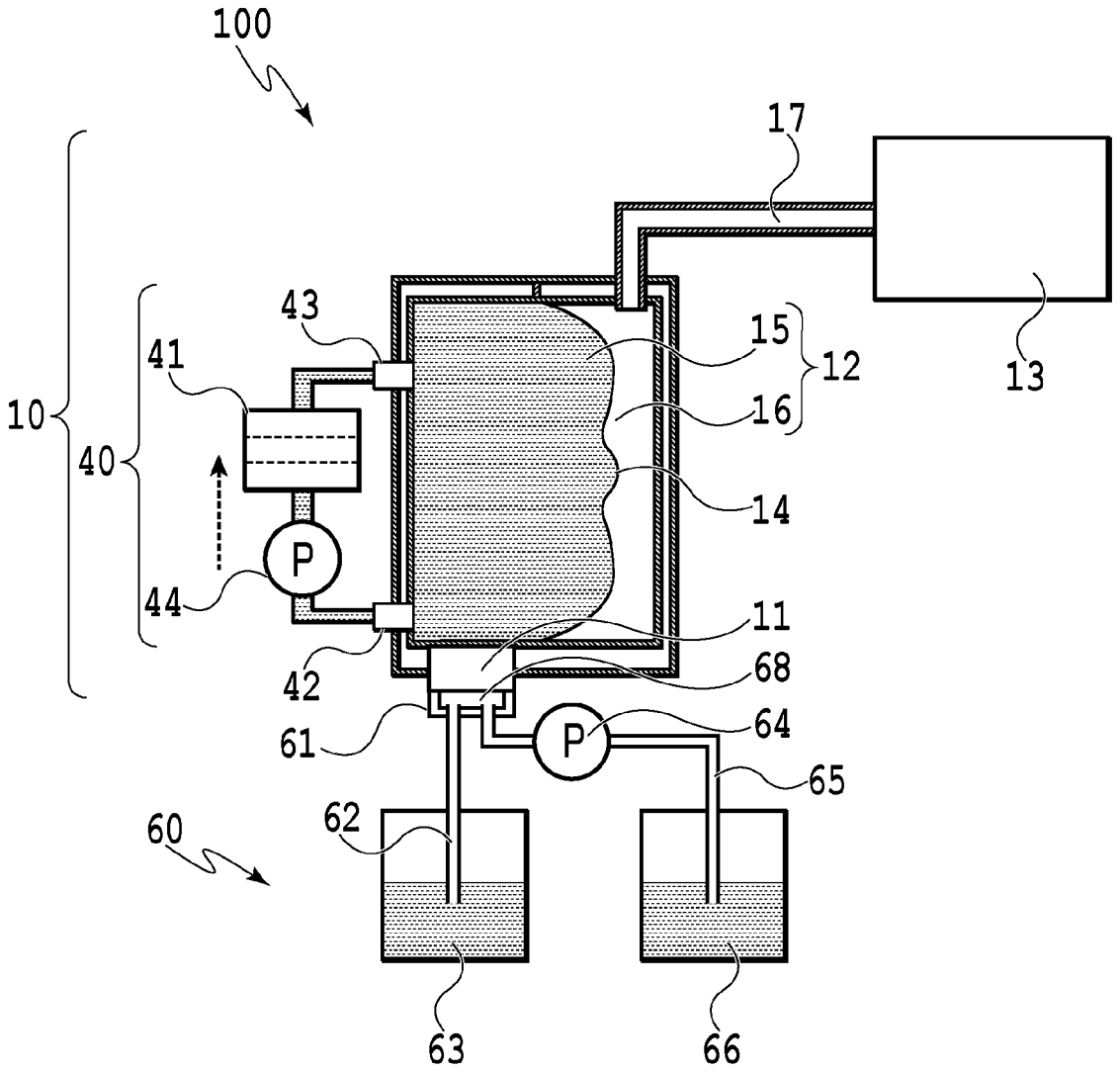
FIG. 8 illustrates a view showing a module substrate cleaning apparatus.

FIG. 8 illustrates a module substrate cleaning apparatus 100 of this embodiment. The module substrate cleaning apparatus 100 includes the ejection device 10, a supply tank 63, a supply pipe 62, a cleaning cap 61, a discharge pipe 65, a discharge tank 66, a pressure controller 64 etc. The supply tank 63 is a tank for supplying liquid to the cleaning cap 61, and the cleaning cap 61 is connected with the supply tank 63 with the supply pipe 62. Liquid to be supplied to the cleaning cap 61 is preferably similar to the substance to be ejected.

Alternatively, cleaning liquid is used for the liquid to be supplied to the cleaning cap 61, and after the use of the cleaning liquid, cleaning may be performed with similar liquid to the substance to be ejected. On this occasion, purge is conducted until the cleaning liquid in the flow path and in the module substrate is sufficiently replaced with similar liquid to the substance to be ejected. Liquid for solving organic materials adhering to the module substrate may be used for a cleaning liquid. Specifically, examples of organic materials possible of adhering to the module substrate include acrylic- or silicone-based adhesives. Therefore, examples of liquids for solving these organic materials include alcohols such as isopropyl alcohol and ethanol, and ethers such as propylene glycol monomethyl ether acetate (PGMEA). For the cleaning liquid, one of materials contained in the substance to be ejected may be used. Hereinafter, a case where the substance to be ejected is used as liquid in the supply tank 63 will be explained.

The module substrate cleaning apparatus 100 performs the cleaning of the module substrate 57 by generating plural times alternately a flow of the substance to be ejected from the ejection opening 19 toward the common liquid chamber 56 (a first cleaning process) and a flow of the substance to be ejected from the common liquid chamber 56 toward the ejection opening 19 (a second cleaning process). In this way, by performing plural times cleaning by different flows, foreign matter adhering to the inside of the ejection opening (inside of a nozzle) or to a head surface can be removed suitably even when these are larger than the ejection opening 19. Hereinafter, the cleaning method with the module substrate cleaning apparatus 100 will be described in detail.

The cleaning cap 61 abuts on the module substrate 57, and, as a consequence, covers all ejection openings 19 located in the ejection opening-side surface 58 (head surface) of the module substrate 57 to form a first space 68 from the ejection opening-side surface 58 and the cleaning cap 61. The discharge tank 66 is a tank for discharging the substance to be ejected having been discharged from the first space 68, and the first space 68 is connected with the discharge tank 66 through the discharge pipe 65. For the discharge pipe 65, the pressure controller 64 is provided, and by controlling the pressure inside the first space 68 with the pressure controller 64, the substance to be ejected is supplied to the first space 68 from the supply tank 63. As mentioned above, the pressure inside the storage portion 15 can be controlled with the pressure control portion 13. Since the storage portion 15 is communicated with a second space 67, which is a combined space of the common liquid chamber 56 inside the ejection portion 11 and an inside 55 of the storage container 12, the pressure inside the second space 67 is also controlled with the pressure control portion 13.

Here, to generate a flow in the module substrate 57, between the first space 68 and the second space 67 sandwiching the module substrate 57, pressure of either one of the spaces may be set to be higher than that of the other space. In other words, by making a difference between a pressure P1 of the first space 68 and a pressure P2 of the second space 67, a flow of the substance to be ejected can be generated in the module substrate 57 (in the nozzle).

In a case where the pressure P1 is higher than the pressure P2 and the circulation portion 40 circulates the substance to be ejected inside the storage portion 15, there are two patterns in the generated flow. In a case where the difference between the pressure P1 and the pressure P2 is small (P1>P2), there are generated a flow from the ejection opening 19 toward the supply opening 21 and a flow along the supply opening-side surface 59 in the common liquid chamber 56. In a case where the difference between the pressure P1 and the pressure P2 is large (P1>>P2), a flow from the ejection opening 19 toward the supply opening 21 is generated.

Inversely, in a case where the pressure P1 is lower than the pressure P2, too, there are two patterns in the generated flow. In a case where the difference between the pressure P1 and the pressure P2 is small (P1<P2), there are generated a flow from the supply opening 21 toward the ejection opening 19 and a flow of the substance to be ejected along the ejection opening-side surface 58. In a case where the difference between the pressure P1 and the pressure P2 is large (P1<<P2), a flow from the supply opening 21 toward the ejection opening 19 is generated. By generating different flows in the module substrate 57 on the basis of combinations of the pressure P1 and the pressure P2 in this way, cleaning of the supply opening-side surface 59, the ejection opening-side surface 58 and a nozzle inside 20 with one cleaning apparatus becomes possible. The cleaning is performed by vibrating the substance to be ejected with above-described flow from the ejection opening 19 toward the supply opening 21 and flow from the supply opening 21 toward the ejection opening 19.

Next, order of portions to be cleaned will be explained. In the present invention, first the cleaning of the supply opening-side surface 59 and the ejection opening-side surface 58 is performed, and after that the cleaning of the nozzle inside 20 is performed. The reason is that, if the cleaning of the nozzle inside 20 is performed earlier, foreign matter adhering to the supply opening-side surface 59 and the ejection opening-side surface 58 may come into the nozzle inside 20 from the supply opening 21 and/or the ejection opening 19. In a case where a foreign matter having come is large, it may cause clogging of the nozzle 54. Therefore, the supply opening-side surface 59 and the ejection opening-side surface 58 are cleaned earlier.

Figure 9:
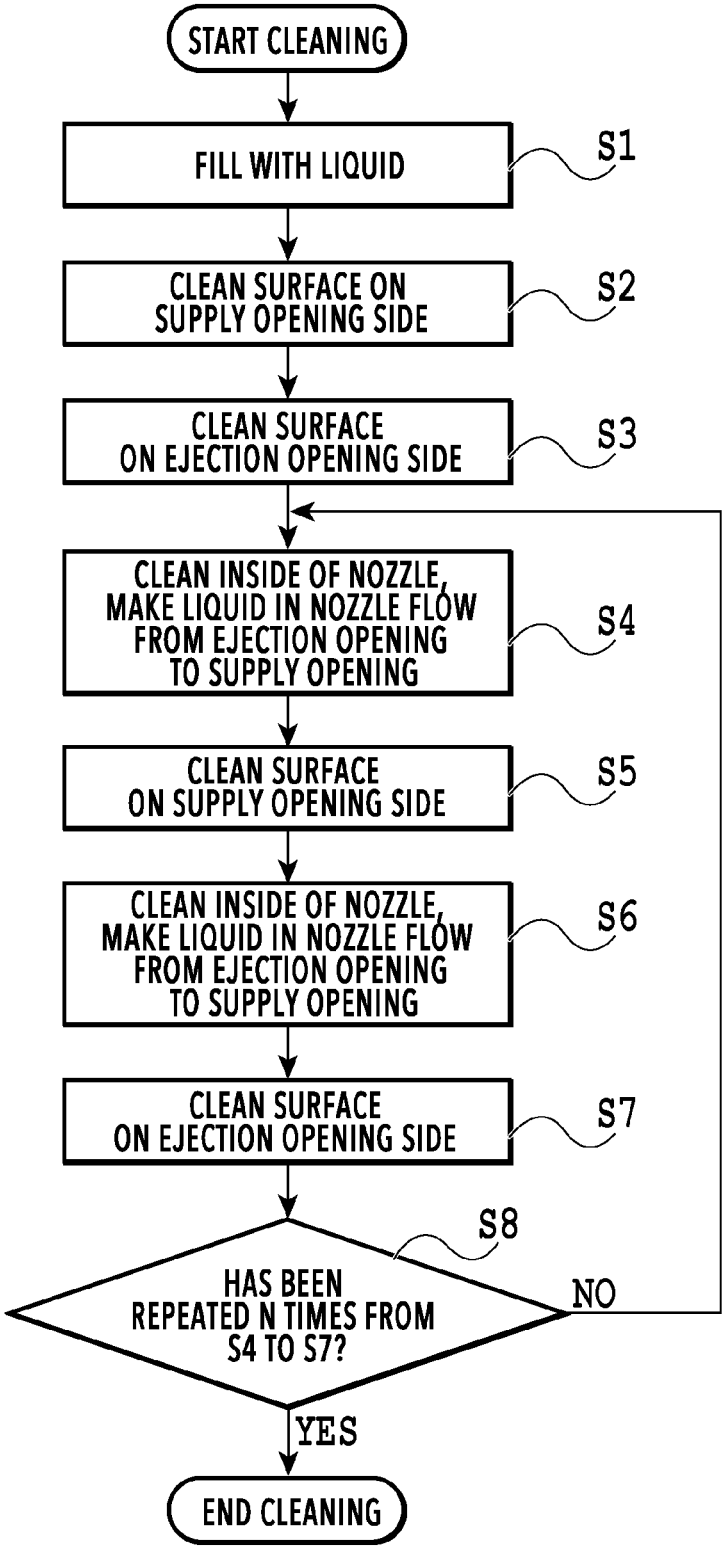
FIG. 9 illustrates a flow chart showing a cleaning process.

FIG. 9 illustrates a flow chart showing the cleaning process in this embodiment. Hereinafter, with this flow chart, processing in the cleaning process in this embodiment will be explained. When the cleaning process is started in a state where the cleaning cap 61 abuts on the ejection portion 11, in S1, the first space 68 of the cleaning cap 61, and the supply pipe 62 and the discharge pipe 65 of the module substrate cleaning apparatus 100 are filled with the substance to be ejected, prior to the cleaning of the module substrate. For that purpose, the pressure P1 of the pressure controller 64 is turned down from 0 kPa to a negative value. Consequently the pressure in the first space 68 is decreased to generate a flow of the substance to be ejected from the supply tank 63 toward the discharge tank 66 via the first space 68, and the first space 68, the supply pipe 62 and the discharge pipe 65 are filled with the substance to be ejected. However, this procedure alone may not fill the upper portion of the first space 68 with the substance to be ejected. Therefore, next, the pressure P2 of the second space 67 is increased from 0 kPa to a positive value with the pressure control portion 13 to make the pressure P2 > the pressure P1 (P1<0 kPa, P2>0 kPa), and thus a flow of the substance to be ejected from the ejection opening 19 toward the first space 68 is generated. Consequently the substance to be ejected is filled to the upper portion of the first space 68, and the substance to be ejected is filled up in the entire first space 68.

After that, in S2, the cleaning of the supply opening-side surface (supply opening face) 59 (supply opening face cleaning) is performed. Here, first the pressure control portion 13 decreases the pressure P2 of the second space 67 to set the pressure P2 of the second space 67 to be lower than the pressure P1 of the first space 68 (P1>P2, P1<0 kPa, P2<0 kPa). Consequently, a flow of the substance to be ejected from the ejection opening 19 toward the supply opening 21 is generated in the module substrate 57. Furthermore, by circulating the substance to be ejected inside the storage portion 15 with the circulation portion 40, a flow of the substance to be ejected along the supply opening-side surface 59 is induced to remove foreign matter adhering to the supply opening-side surface 59.

Then, in S3, cleaning of the ejection opening-side surface (ejection opening face) 58 (ejection opening face cleaning) is performed. The pressure control portion 13 increases the pressure P2 of the second space 67 to set the pressure P2 of the second space 67 to be higher than the pressure P1 of the first space 68 (P1<P2, P1<0 kPa, P2>0 kPa). Consequently, a flow of the substance to be ejected from the supply opening 21 toward the ejection opening 19 is generated in the module substrate 57 to remove foreign matter adhering to the ejection opening-side surface 58.

After that, in S4, nozzle inside cleaning A, in which the substance to be ejected is made to flow from the ejection opening 19 to the supply opening 21, is performed. Here, the pressure control portion 13 decreases the pressure P2 of the second space 67 to set the pressure P2 of the second space 67 to be lower than the pressure P1 of the first space 68 (P2<<P1, P1<0 kPa, P2<0 kPa). Consequently, by generating a flow of the substance to be ejected from the ejection opening 19 toward the supply opening 21, foreign matter adhering to the wall of the nozzle inside 20 are flushed out from the supply opening 21. On this occasion, preferably the cleaning is performed while driving simultaneously the energy-generating element 18. Here, it is considered that foreign matter made to flow out from the supply opening 21 in S4 may adhere to the supply opening-side surface 59. Therefore, in S5, a flow along the supply opening-side surface 59 is generated.

In S5, the pressure control portion 13 increases the pressure P2 of the second space 67 to set the pressure P2 of the second space 67 to be lower than the pressure P1 of the first space 68 (P2<P1, P1<0 kPa, P2<0 kPa). Consequently, a flow of the substance to be ejected from the ejection opening 19 toward the supply opening 21 is generated to induce a flow of the substance to be ejected along the supply opening-side surface 59, and foreign matter are removed from the supply opening-side surface 59. Simultaneously the circulation portion 40 circulates the substance to be ejected inside the storage portion 15, and foreign matter released from the supply opening-side surface 59 are filtrated with the filter 41.

After that, in S6, nozzle inside cleaning B, in which the substance to be ejected is made to flow from the supply opening 21 to the ejection opening 19, is performed. The pressure control portion 13 increases the pressure P2 of the second space 67 to set the pressure P2 of the second space 67 to be higher than the pressure P1 of the first space 68 (P2>>P1, P1<0 kPa, P2>0 kPa). Consequently, a flow of the substance to be ejected from the supply opening 21 toward the ejection opening 19 is generated to flush out foreign matter adhering to the wall of the nozzle inside 20 from the ejection opening 19. Here, it is considered that foreign matter made to flow out from the ejection opening 19 in S6 may adhere to the ejection opening-side surface 58. Therefore, in S7, a flow along the ejection opening-side surface 58 is generated.

In S7, the pressure control portion 13 decreases the pressure P2 of the second space 67 to set the pressure P2 of the second space 67 to be higher than the pressure P1 of the first space 68 (P2>P1, P1<0 kPa, P2>0 kPa). Consequently, a flow of the substance to be ejected from the supply opening 21 toward the ejection opening 19 is generated to induce a flow of the substance to be ejected along the ejection opening-side surface 58, and foreign matter are removed from the ejection opening-side surface 58.

After that, in S8, whether or not processing from S4 to S7 has been repeated N (N>0) times is determined. If the processing has not been repeated N times, the process returns to S4. When it is determined in S8 that processing from S4 to S7 has been completed N times, the cleaning process is ended.

Meanwhile, in the above-described cleaning, the cleaning is performed by varying the pressure P1 and the pressure P2 using both of the pressure control portion 13 and the pressure controller 64, but this is not limitative. That is, after filling the first space 68, and the supply pipe 62 and the discharge pipe 65 with the substance to be ejected, cleaning may be performed by generating a difference between the pressure P1 and the pressure P2 by fixing pressure with either one of the pressure control portion 13 or the pressure controller 64 and regulating the pressure with the other.

Figure 10:
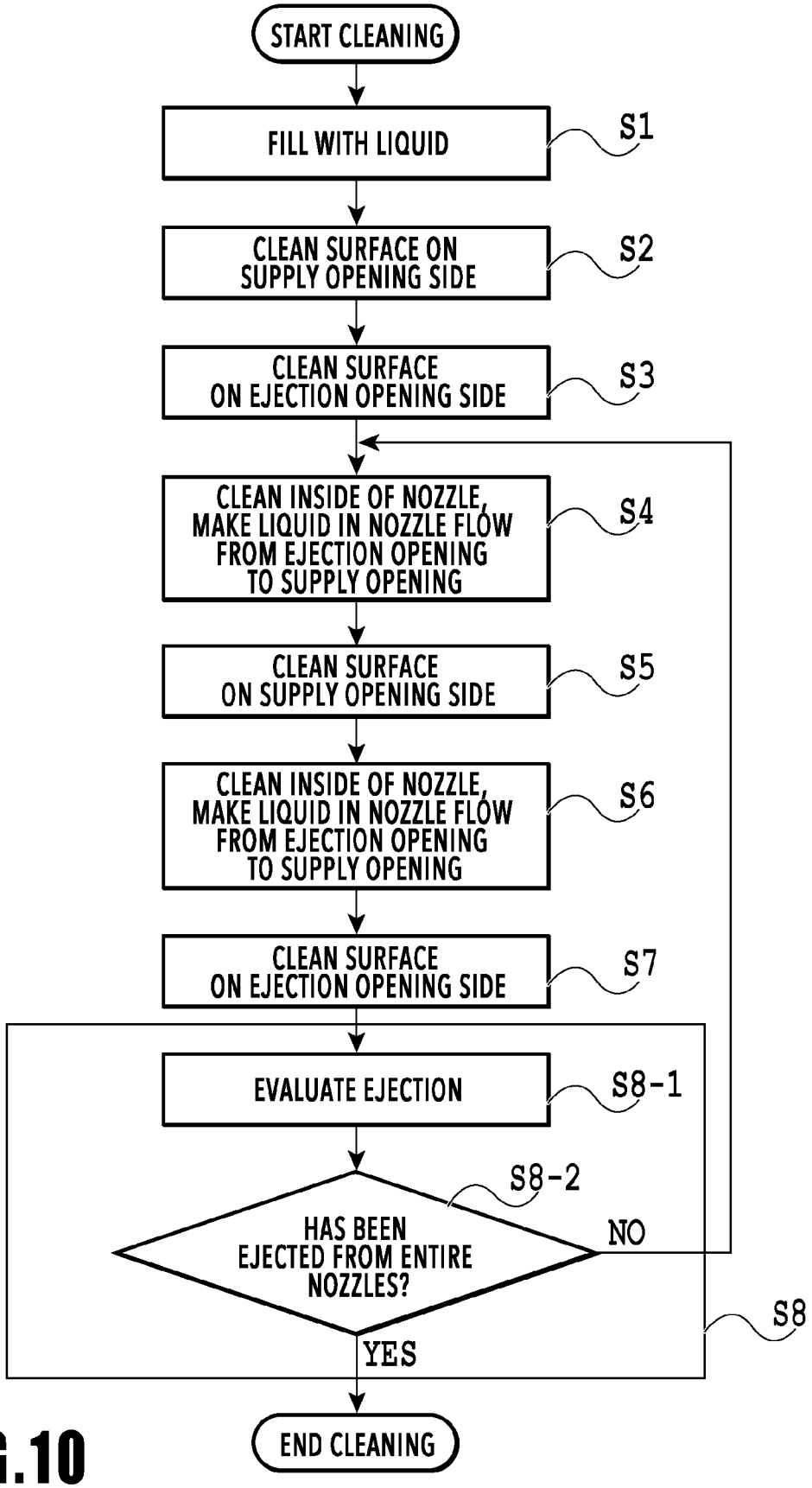
FIG. 10 illustrates a flow chart showing a cleaning process.
Figure 12:
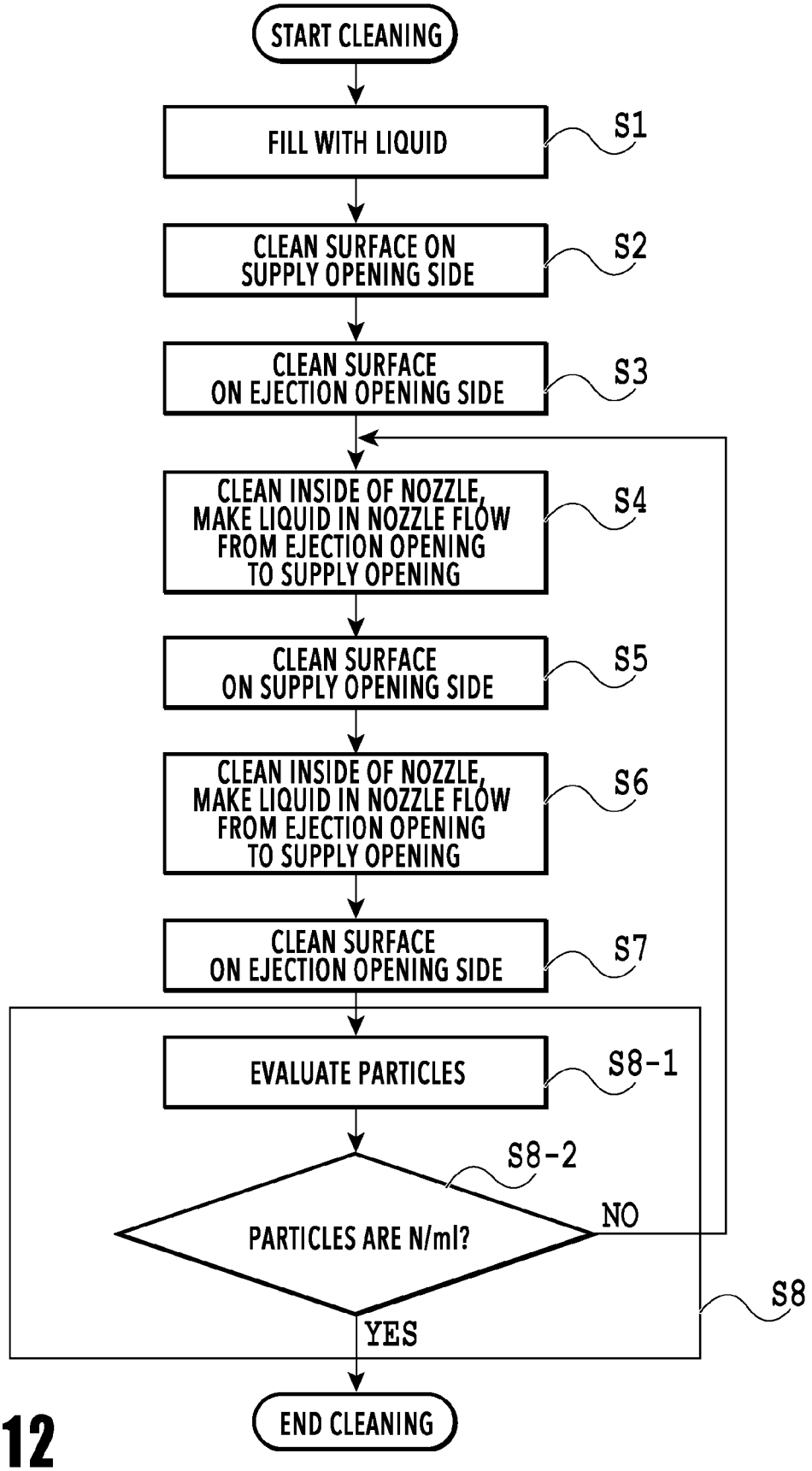
FIG. 12 illustrates a flow chart of a cleaning process.

As a technique for determining end of the cleaning process (end determination), an ejection evaluation result (ejection result) using an ejection evaluation device may be used, or a particle measurement result using a particle measurement device may be used. FIGS. 10 and 12 illustrate flow charts showing cleaning processes in this embodiment, which are similar to FIG. 9 from S1 to S7, but are different in the process of determining the end of the cleaning process. Hereinafter, an instance where end of a cleaning process is determined on the basis of an ejection evaluation result using an ejection evaluation device will be explained with the flow chart in FIG. 10, and an instance where end of a cleaning process is determined on the basis of a particle measurement result using a particle measurement device will be explained with the flow chart in FIG. 12.

Figure 11:
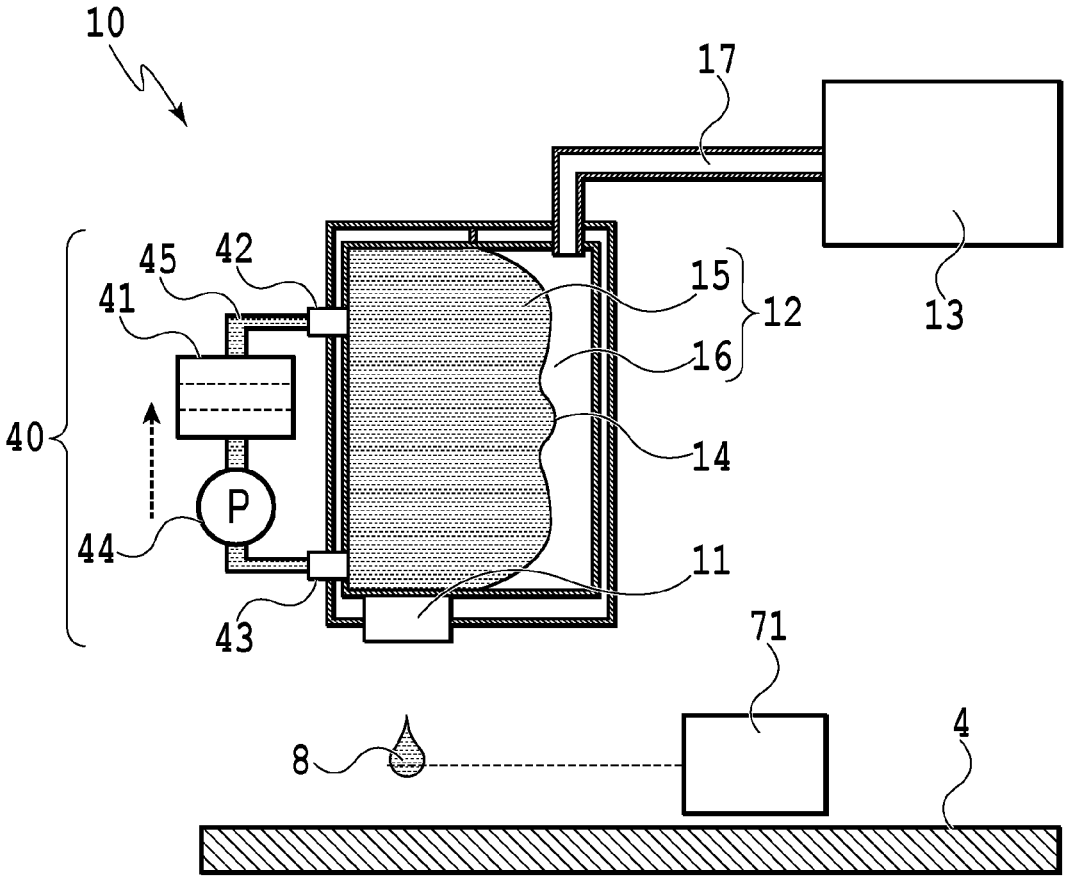
FIG. 11 illustrates a view showing a configuration of a principal part of an ejection device.

In FIG. 10, in S8, processing of performing ejection evaluation (S8-1) and processing of determining whether or not the result of the ejection evaluation is good (S8-2) are performed. In FIG. 11, an example of an ejection device for use in S8-1 is shown. By an ejection detection mechanism 71 shown in FIG. 11, the substance to be ejected 8 is detected. The ejection detection mechanism 71 is located in a position in which it can obtain information about the substance to be ejected 8 ejected from the ejection device 10. The information about the substance to be ejected 8 may be one for processing an image acquired with a camera etc., or one for detecting light emitted from an emission portion (not illustrated) and detecting whether or not an ejected droplet has passed through the emitted light. In S8-2, by confirming, for example, that the liquid has been ejected from an ejection hole with an intended speed and volume on the basis of the information obtained by the ejection detection mechanism 71 and determining that the result of the ejection evaluation is good, and the cleaning process is ended.

Figure 13:
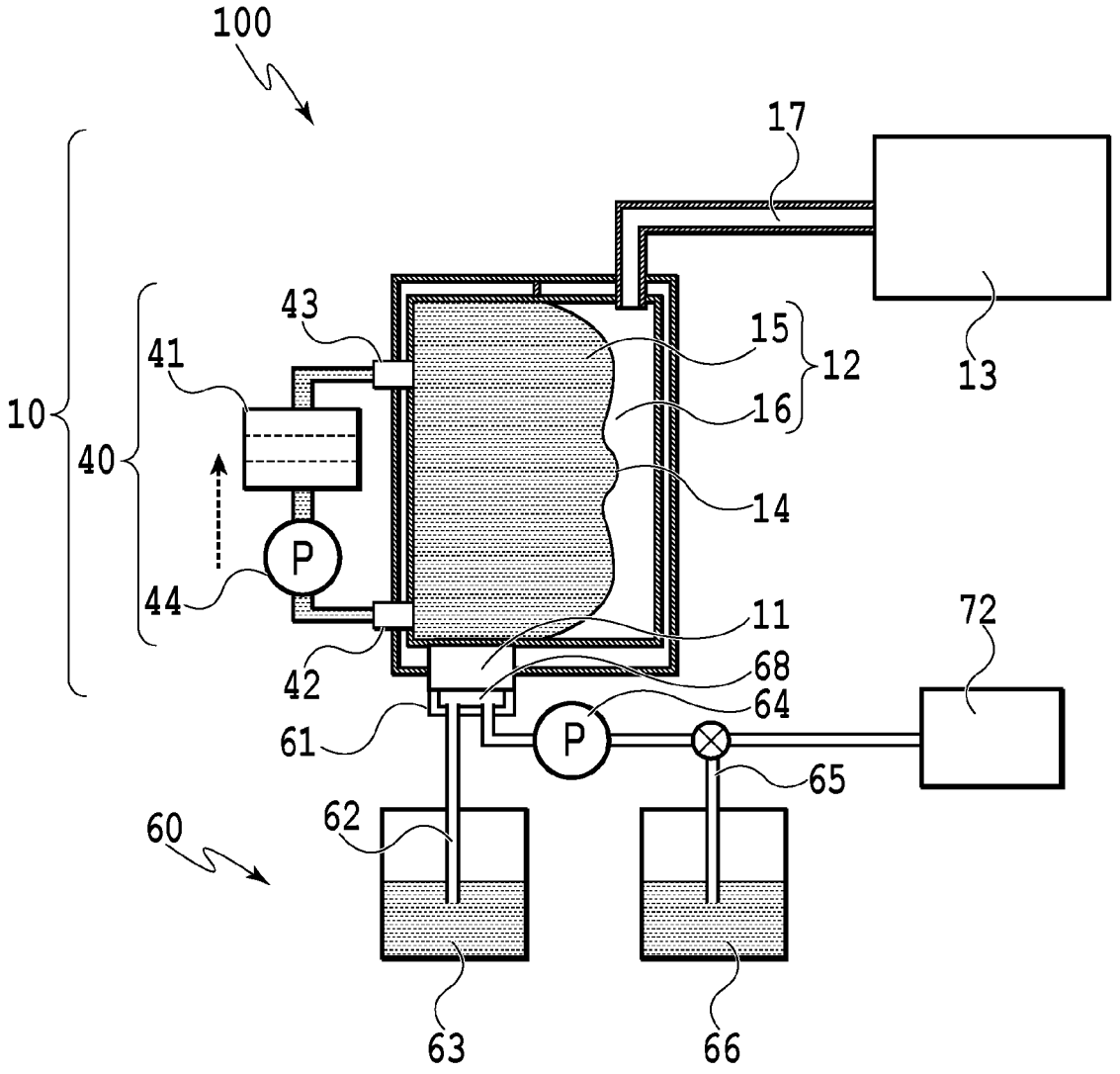
FIG. 13 illustrates a view showing a module substrate cleaning apparatus.

In FIG. 12, in S8, processing of performing particle evaluation (S8-1), and processing whether or not the result of particle measurement is good (S8-2) are performed. In FIG. 13, an example of a particle measurement device for use in S8-1 is shown. With a particle measurement device 72 shown in FIG. 13, particle measurement in a cleaning liquid is performed. By confirming that the result of particle measurement is not more than 0.1/ml and determining that the result of particle measurement is good in S8-2, the cleaning process is ended. For cleaning liquid for performing particle measurement, water commonly having high particle measurement sensitivity may be used, in addition to liquid for solving an organic substance.

Here, the reason will be explained why the processing (S4) performed while generating a flow from the ejection opening 19 to the supply opening 21 is performed prior to the processing (S6) performed while generating a flow from the supply opening 21 to the ejection opening 19 in the cleaning of the nozzle inside 20 in the above-described cleaning process. The ejection opening 19 has the smallest cross-section in the flow path through which the substance to be ejected flows. Therefore, in a case where a flow from the supply opening 21 to the ejection opening 19 is induced first, if foreign matter larger than the opening area of the ejection opening 19 adheres to the wall of the nozzle inside 20, clogging may occur at the ejection opening 19. Consequently, in this embodiment, by performing in advance the processing of generating a flow from the ejection opening 19 to the supply opening 21, foreign matter adhering to the wall of the nozzle inside 20 is discharged from the supply opening 21 to prevent clogging at the ejection opening 19.

In this way, cleaning of a module substrate is performed by vibrating a substance to be ejected by generating alternately a flow from an ejection opening to a supply opening and a flow from a supply opening to an ejection opening. Consequently, a cleaning method for a module substrate and a cleaning apparatus capable of removing more reliably foreign matter in an ejection opening and on a head surface have been actualized.

Fifth Embodiment

Hereinafter, a fifth embodiment will be explained. Meanwhile, the basic configuration of this embodiment is the same as that of the first embodiment, and therefore only characteristic configurations will be explained in what follows.

In the module substrate cleaning apparatus 100 of this embodiment, in a similar way to the fourth embodiment, cleaning of the module substrate 57 is performed by generating plural times alternately a flow of a substance to be ejected from the ejection opening 19 toward the common liquid chamber 56, and a flow of the substance to be ejected from the common liquid chamber 56 toward the ejection opening 19.

In addition to this cleaning operation, in this embodiment, the energy-generating element 18 is driven. By driving the energy-generating element 18 in the cleaning operation of the module substrate 57 in this way, vibration is given to the substance to be ejected to flush out foreign matter from the ejection opening 19. Consequently, the module substrate 57 can be cleaned.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2018-245000, filed Dec. 27, 2018, and No. 2018-150299, filed Aug. 9, 2018, and No. 2018-243197, filed Dec. 26, 2018, and No, 2019-122806, filed Jul. 1, 2019, which are hereby incorporated by reference wherein in their entirety.

What is claimed is:

1. A liquid ejection device, comprising:

a storage container storing liquid;

an ejection device configured to eject the liquid stored in the storage container from an ejection opening provided on an ejection opening face;

a liquid holding device configured to hold liquid between itself and the ejection opening face;

a liquid collecting device configured to collect the liquid held by the liquid holding device; and a vibrating device configured to vibrate the liquid held by the liquid holding device, the vibrating device being located inside the ejection device, wherein the ejection device has a supply opening that is provided on a surface facing the ejection opening face and is in communication with the ejection opening, and wherein the vibrating device causes liquid flow from the supply opening to the ejection opening and causes liquid flow from the ejection opening to the supply opening.

2. The liquid ejection device according to claim 1, wherein the vibrating device vibrates liquid by ejection energy that is used when the ejection device ejects liquid.

3. The liquid ejection device according to claim 1, wherein the vibrating device is a device configured to generate ultrasonic waves and ultrasonic waves generated by the vibrating device vibrate the liquid held by the liquid holding device.

4. The liquid ejection device according to claim 1, wherein a mechanism for ejecting liquid from the ejection device is driven along with a flow of liquid from the supply opening to the ejection opening and a flow of liquid from the ejection opening to the supply opening by the vibrating device.

5. The liquid ejection device according to claim 1, wherein the liquid holding device is also as the liquid collecting device and has plural comb teeth disposed at a predetermined spacing, liquid being collected between the comb teeth.

6. The liquid ejection device according to claim 1, further comprising a liquid supplying device configured to supply liquid between the ejection opening face and the liquid holding device, wherein a liquid column is formed between the ejection opening face and the liquid holding device by supplying liquid from the liquid supplying device.

7. The liquid ejection device according to claim 6, wherein the liquid supplying device a second device configured to supply liquid in connection with the ejection device or with the liquid holding device.

8. The liquid ejection device according to claim 7, wherein the ejection device is for ejecting a first liquid, the second device configured to supply liquid is for supplying a second liquid, and the second liquid is liquid that decreases viscosity of the first liquid by contacting with the first liquid.

9. The liquid ejection device according to claim 7, wherein the ejection device is for ejecting a first liquid, the liquid supplying device is for supplying a second liquid, and the first liquid and the second liquid are liquids of the same kind.

10. The liquid ejection device according to claim 1, wherein the liquid collecting device is for collecting liquid by negative pressure generated by a device configured to generate negative pressure connected with the liquid holding device.

11. The liquid ejection device according to claim 1, wherein the liquid is an imprint material.

12. The liquid ejection device according to claim 1, wherein the ejection opening face is not in contact with the liquid holding device.

13. A cleaning apparatus for cleaning a module substrate, the substrate being for ejecting liquid from an ejection opening, the apparatus comprising:

a liquid holding device configured to hold liquid between itself and an ejection opening face of the module substrate, the ejection opening being formed on the ejection opening face;

a liquid supply device configured to supply liquid between the ejection opening face and the liquid holding device;

a vibrating device configured to vibrate the liquid held by the liquid holding device, the vibrating device being located inside the module substrate; and a liquid collecting device configured to collect the liquid held by the liquid holding device, wherein the module substrate has a supply opening in communication with the ejection opening, the supply opening being in a surface facing the ejection opening face, and wherein the vibrating device causes liquid flow from the supply opening to the ejection and causes liquid flow from the ejection opening to the supply opening.

14. The cleaning apparatus according to claim 13, wherein a mechanism for ejecting liquid of the module substrate is to be driven along with a flow of liquid from the supply opening to the ejection opening and a flow of liquid from the ejection opening to the supply opening by the vibrating device.

15. A cleaning method for a module substrate for ejecting liquid from an ejection opening, comprising:

an arrangement process arranging an ejection opening face of the module substrate, to which the ejection opening has been formed, and a holding portion of a holding member capable of holding liquid between itself and the ejection opening face, so as to face each other at a predetermined space;

a holding process supplying and holding liquid between the ejection opening face and the holding portion;

a vibrating process vibrating the liquid held in the holding process using a vibrating device, the vibrating device being located inside the module substrate;

a collecting process collecting the liquid supplied between the ejection opening face and the holding portion;

a first cleaning process making liquid flow from a supply opening, which is equipped for a surface facing the ejection opening face of the module substrate and is in communication with the ejection opening, to the ejection opening; and a second cleaning process making liquid flow from the ejection opening to the supply opening.

16. The cleaning method according to claim 15, wherein a mechanism for ejecting liquid of the module substrate is driven in at least one of cleaning processes of the first cleaning process and the second cleaning process.

* * * * *